US005590693A

United States Patent [19]

Pedrini et al.

[11] Patent Number: 5,590,693

[45] Date of Patent: Jan. 7, 1997

[54] ROTATABLE THREAD ARRESTER FOR WEFT FEEDERS FOR AIR-JET LOOMS

[75] Inventors: Giovanni Pedrini; Pietro Zenoni, both of Leffe, Italy

[73] Assignee: L.G.L. Electronics S.p.A., Bergamo, Italy

[21] Appl. No.: 499,844

[22] Filed: Jul. 10, 1995

[30] Foreign Application Priority Data

Jul. 19, 1994 [IT] Italy ..... TO94A0592
Feb. 21, 1995 [IT] Italy ..... TO95A0123

[51] Int. Cl.[6] ..... D03D 47/36; B65H 51/22

[52] U.S. Cl. ..... 139/452

[58] Field of Search ..... 139/452; 242/47.01

[56] References Cited

U.S. PATENT DOCUMENTS

| | | | |
|---|---|---|---|
| 4,811,762 | 3/1989 | Bucher et al. | 139/452 |
| 4,901,772 | 2/1990 | Van Bogaert et al. . | |
| 5,016,681 | 5/1991 | Ghiardo | 139/452 |
| 5,462,096 | 10/1995 | Svanstroem et al. | 139/452 |

FOREIGN PATENT DOCUMENTS

| | | |
|---|---|---|
| 0253760 | 1/1988 | European Pat. Off. . |
| 0344100 | 11/1989 | European Pat. Off. . |
| 0436197 | 7/1991 | European Pat. Off. . |
| 4131652 | 4/1993 | Germany . |
| 9304225 | 3/1993 | WIPO . |
| 9325742 | 12/1993 | WIPO . |

*Primary Examiner*—Andy Falik
*Attorney, Agent, or Firm*—Guido Modiano; Albert Josif

[57] ABSTRACT

A rotatable thread arrester, associated with a thread feeder, includes an arrester finger for the thread that is movable with respect to the reel of the feeder under the control of a movement device and engages the thread so as to stop its unwinding from the reel and viceversa in order to damp the peak of the mechanical tension generated on the thread by the contact with the arrester finger. The arrester finger is oscillatably suspended about an axis "x" that is parallel to the axis "y" of the reel and is controlled by the action of a motor which rotates the arrester in the thread unwinding direction, so that the arrester finger, in the arresting position, follows the thread unwinding from the reel.

20 Claims, 5 Drawing Sheets

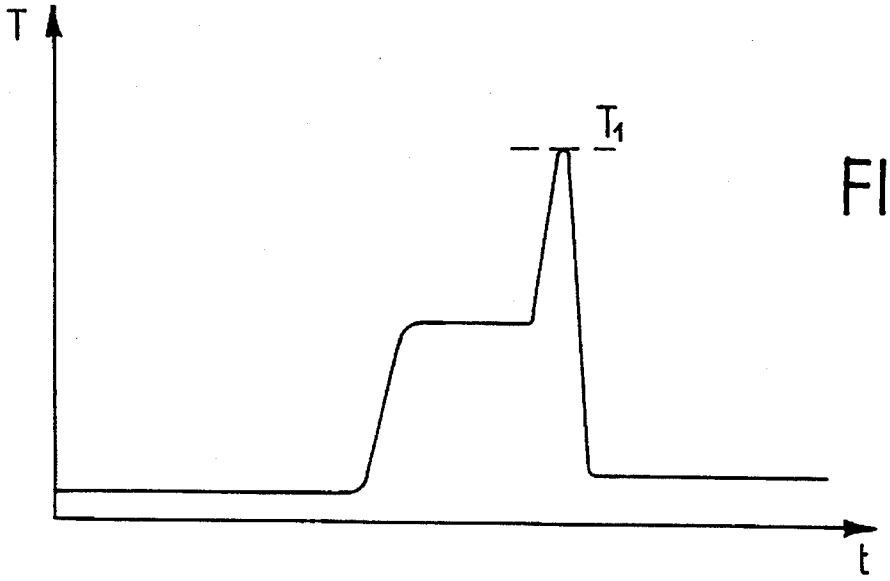
FIG.1
FIG. 3
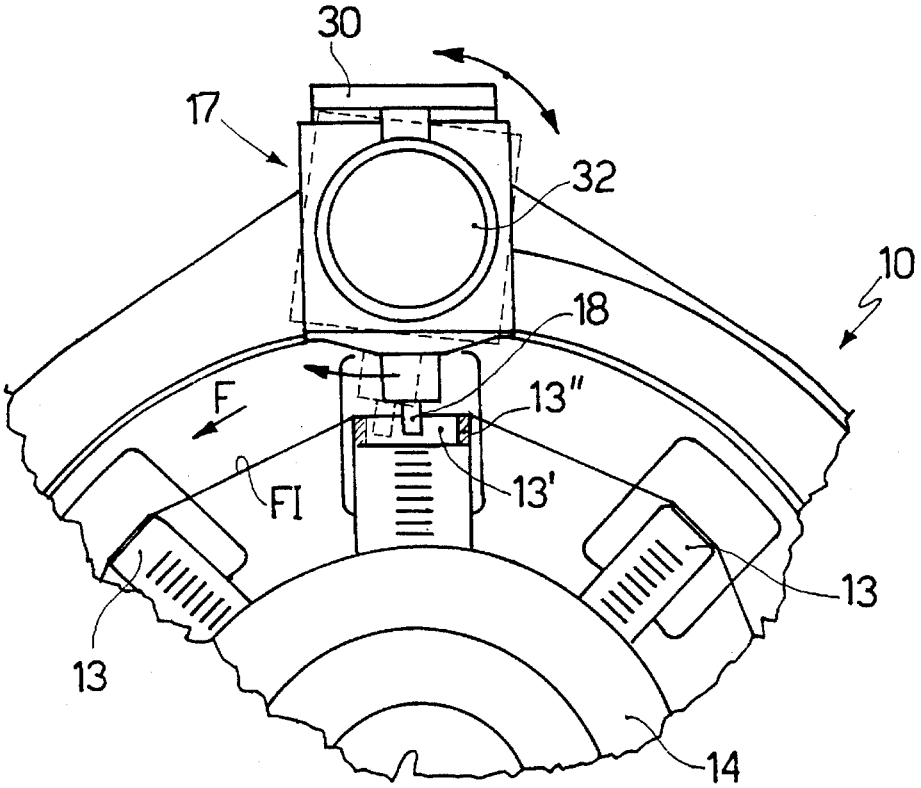

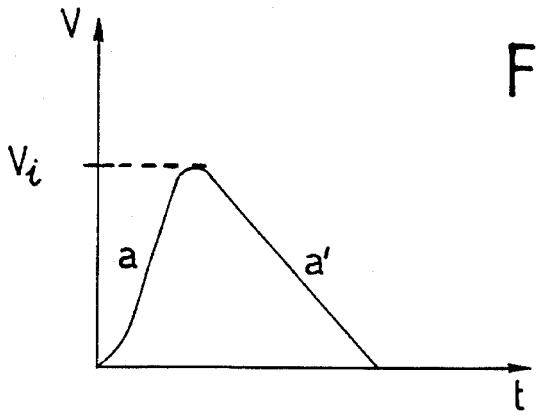
FIG. 6
FIG. 4
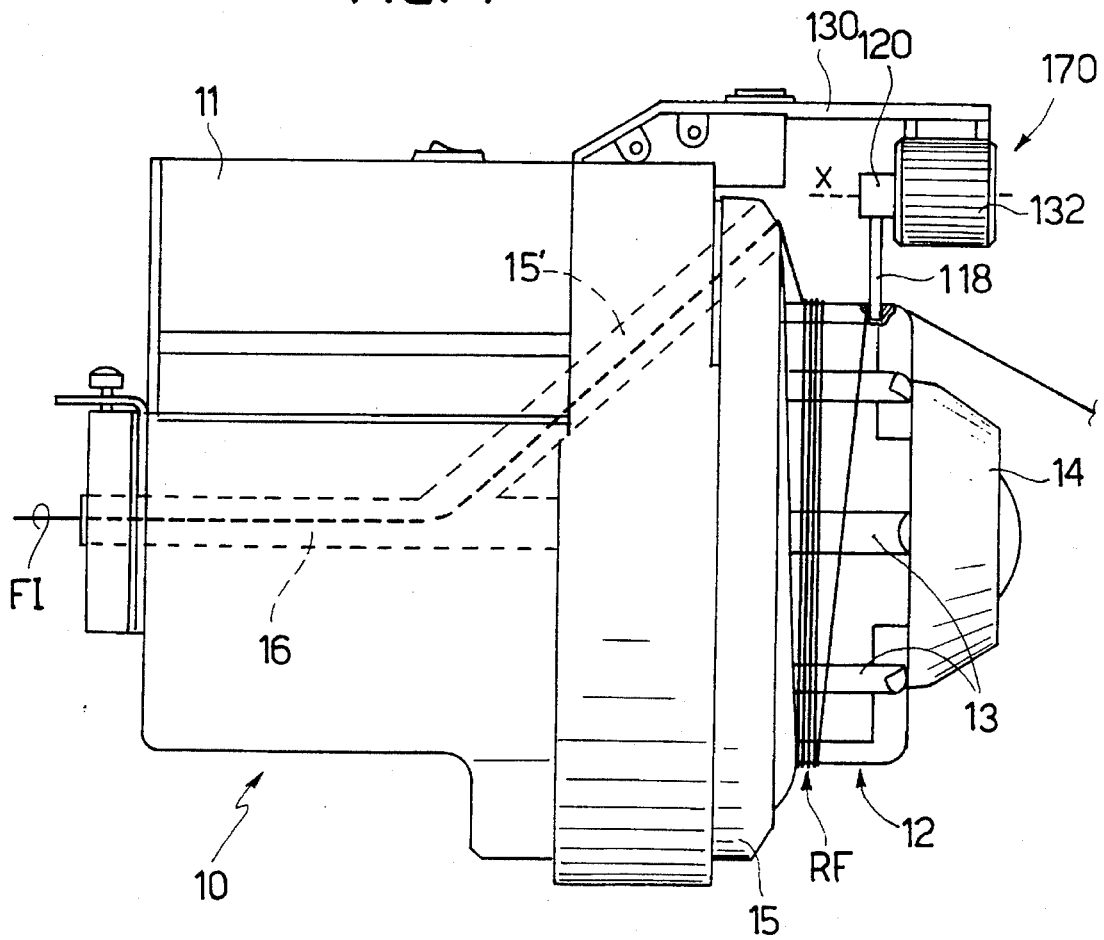

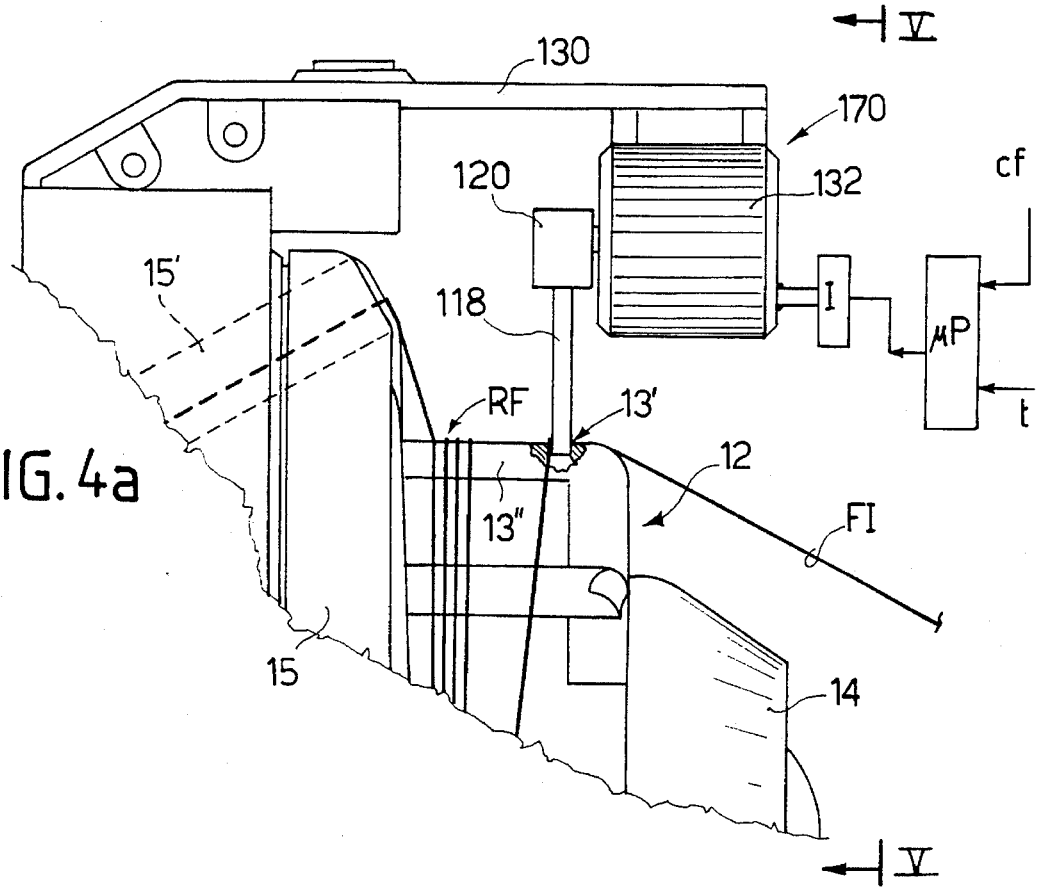
FIG. 4a
FIG. 5
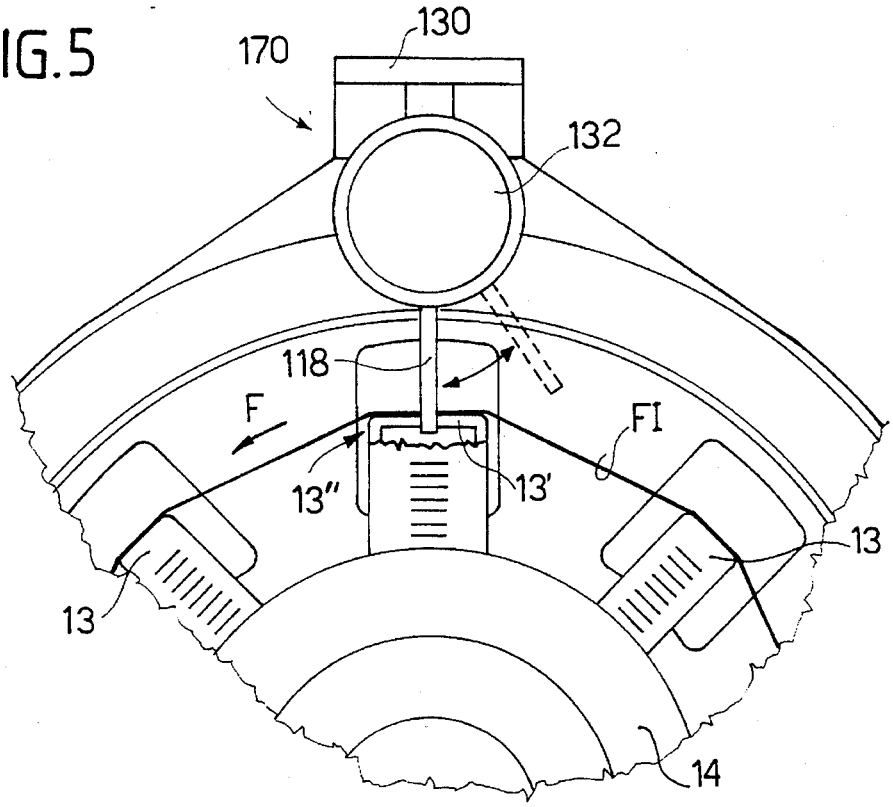

ROTATABLE THREAD ARRESTER FOR WEFT FEEDERS FOR AIR-JET LOOMS

BACKGROUND OF THE INVENTION

The present invention relates to a thread arrester for weft feeders for air-jet looms.

It is known that weft feeders are devices that accumulate a reserve of thread in the form of turns wound around a fixed reel or drum and feed the loom by unwinding the turns in an amount equal to the length L of thread required by the loom at each beat, said length being equal to the width of the fabric being formed.

In the specific case of air-jet looms, the pre-feeder lo also has the task of pre-measuring the length L, and this task is performed by counting the unwound turns of thread, for example by means of a photocell, since:

$$L=n\pi D$$

where n is the number of unwound turns and D is the diameter of the fixed drum or reel of the feeder.

The unwinding of the thread is controlled by an electrically-controlled arrester, which, by means of a movable finger acting by contact engagement with the drum, stops the unwinding of the thread when the $n^{th}$ turn has been reached.

In conventional weft feeders, in view of the high speed of a modern air-jet loom, which can insert approximately 1500 meters of weft per minute, the intervention time of the arrester is extremely short and is typically comprised between 10 and 20 ms (milliseconds). It is evident that when the arrester intervenes, a peak $T_1$ of the mechanical tension T of the thread occurs in the portion of thread downstream of said arrester, said tension varying in time t, as shown qualitatively in the diagram of the accompanying FIG. 1.

The peak $T_1$ of the mechanical tension T must be damped appropriately, on penalty of weft thread breakage, which occurs more frequently as the count of said thread decreases. Various auxiliary damping means, interposed between the weft feeder and the loom, are currently used for this purpose. Typically, a conventional tension damping device is constituted by at least one set of three rollers, the intermediate roller being movable; the weft thread is passed between said rollers along a path that forms loops which during thread braking are straightened since the intermediate roller or rollers flex, thus allowing the thread to elongate and consequently damping said tension peak.

However, this known auxiliary damping system, and others, based for example on the flexing of elastic means, do not yield satisfactory results, mainly due to the inertia of the masses of the movable damping elements, which produces significant delays in the intervention of the system, thus limiting its effectiveness.

Said auxiliary damping systems are furthermore physically separated from the weft feeder and accordingly, in addition to requiring adequate installation spaces, they must be selected and adjusted both according to the characteristics of the feeder braking device and to the count of the thread being processed.

SUMMARY OF THE INVENTION

The aim of the present invention is to eliminate these and other drawbacks, and within the scope of this general aim it has the important object of providing a thread arrester that can eliminate the onset of tension peaks on the thread by virtue of a gradual braking action applied to said thread, the pre-measured length L whereof is however kept unchanged.

The device according to the invention thus eliminates the use of auxiliary damping devices of any kind and sort interposed between the pre-feeder and the loom, does not require accurate adjustment operations when the count of the thread being used varies, and entails considerable advantages both from an economical point of view and as far as system functionality is concerned.

According to the present invention, this aim and these objects and advantages are achieved with a thread arrester having the specific features stated in the appended claims.

The invention is essentially based on the concept of giving the movable finger of the braking device a controlled rotation in the direction in which the turns of thread unwind.

This rotation of the device movable finger on one hand does not change the number n of the total turns unwound from the drum, and therefore does not change the pre-measured length L of the thread, and on the other hand produces an effective damping in the braking action and substantially eliminates the onset of said tension peak on the thread.

BRIEF DESCRIPTION OF THE DRAWINGS

Further characteristics and advantages of the device according to the present invention will become apparent from the following detailed description and with reference to the accompanying drawings, given by way of non-limitative example, wherein:

FIG. 1 is a plot of the mechanical tension of the thread as a function of time;

FIG. 3 is a front view, taken along the direction of the arrows III—III of FIG. 2;

FIG. 4 is a partially sectional view of an air-jet loom feeder with the thread arrester according to an embodiment of the present invention;

FIG. 4*a* is an enlarged-scale view of a detail of FIG. 4;

FIG. 5 is a front view, taken in the direction of the arrows V—V of FIG. 4*a;*

FIG. 6 is a diagram of the motion rule of the movable finger of the thread arrester shown in FIG. 4;

DESCRIPTION OF THE PREFERRED EMBODIMENTS

Figure 2:
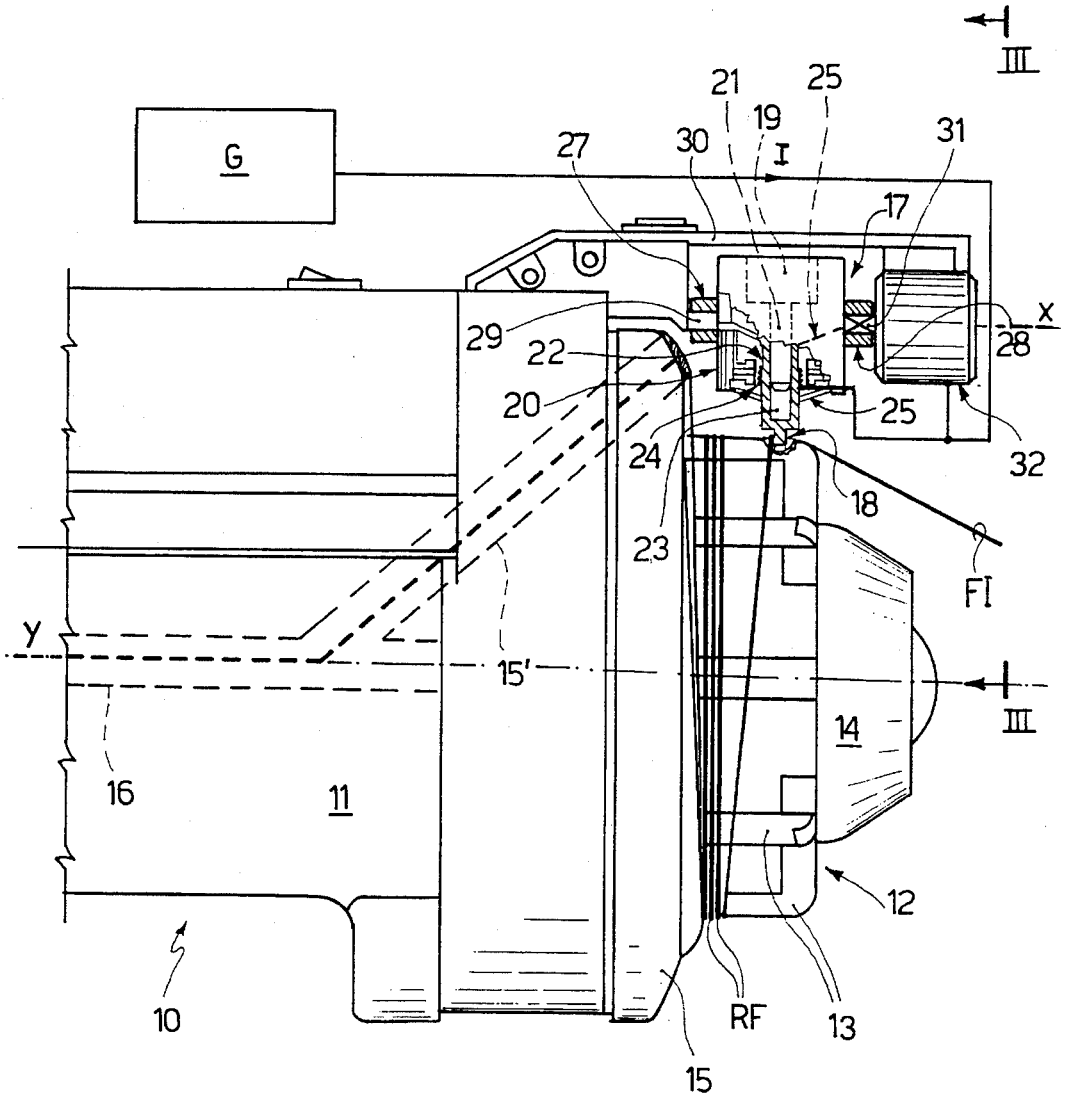
FIG. 2 is a partially sectional partial view of a feeder for air-jet looms equipped with the thread arrester according to an embodiment of the present invention.

With reference to FIGS. 2 and 3, the reference numeral 10 generally designates a weft feeder for air-jet looms comprising, in a per se known manner, a fixed body 11, a fixed drum or reel 12 formed by a plurality of rods 13 supported by a hub 14, and a rotatable disk 15 located at the base of the reel 12 and driven by a hollow drive shaft 16. A hollow rotating arm 15' is rigidly coupled to the disk 15 and is connected to the hollow drive shaft; the thread FI originating from the spool runs in the cavity of the shaft and of the arm and is wound by the disk 15 on the reel 12 to form a reserve of thread turns RF to be fed to the loom.

At each beat of the loom, a number n of turns of thread, equal to the length L of the weft that the loom inserts with said beat, is unwound from the reel 12.

The number of turns that unwind is counted, in a per se known manner, by a photoelectric cell (not shown) that cooperates with a counter; when said counter reaches the last-but-one turn (n–1), it energizes an arrester, generally designated by the reference numeral 17. Said arrester is provided with an arresting finger 18 which, by moving downwardly in a radial direction, enters the slot 13' of a rod 13" of the reel, stopping the unwinding of the thread when the $n^{th}$ (last) turn is reached.

The nature of the arrester 17 is non-limitative as regards the scope of the present invention. In the illustrated example, it is of the electrodynamic type disclosed in the prior European patent publication no. 0581745, and comprises a permanent magnet 19, contained in a cylindrical skirt 20, which extends in a cylindrical axial pivot 21 that delimits an annular air gap 22 together with a circular opening of the skirt 20. A movable fixture 23 is loosely slideably fitted on the cylindrical pivot 21 and is provided with a winding 24 arranged at the gap 22.

The movable fixture 23 is elastically suspended by two annular flat springs 25 and is provided at its free end with the arresting finger 18. An energization current I, supplied by a source G under the control of the counter associated with the photoelectric cell that counts the turns, is made to circulate in the winding 24. Due to the energization current I, the finger 18 moves downwardly, engaging inside an accommodation slot 13' of the underlying rod 13" of the reel 12 in order to engage the turns of thread that unwind from said reel.

According to the present invention, the skirt 20, which constitutes the body of the device 17, is provided with two diametrically opposite external supports 27 and 28 that oscillatably suspend said device about an axis "x" parallel to the axis "y" of the reel 12.

The support 27 is freely rotatably engaged on a respective supporting pivot 29 supported by a structure 30 rigidly coupled to the fixed body 11 of the feeder. The support 28 is fitted on, and keyed to, the drive shaft 31 of a step motor 32, also supported by the fixed structure 30. The energization current I is fed to the motor 32, so that when the arrester 17 is energized and the finger 18 moves downwardly to engage the unwinding thread, the motor 32 is also supplied and turns by one or more steps in the thread unwinding direction, designated by the arrow F, following the movement of the finger 18.

Accordingly, the finger 18 moves, as shown in dashed lines in FIG. 3, in the thread advancement direction, remaining however inside the slot 13', and this causes an effective damping of the tension peak $T_1$ (FIG. 1), which would apply stress to the thread FI, suddenly braked by the finger 18, if the arrester 17 did not move.

According to the embodiment of FIGS. 4 and 5, the arrester 170 comprises an electric motor 132 also of the step type which is suspended from a bracket 130 above the reel 12 and is orientated so that its axis is parallel to the axis of said reel. A hub 120 is keyed on the shaft of the motor 132 and is provided with a radial bar 118 directed towards the reel 12.

Due to the rotation of the shaft of the motor 132, controlled for example by a microprocessor μP, with which a power interface I is associated, the radial bar 118 can oscillate by moving in reverse with respect to the thread turn unwinding direction, designated by the arrow F, from an angular position for engaging the unwinding turns, shown in solid lines in FIG. 5 (six-o'clock position), to a position for releasing said turns, shown in dashed lines in the same figure (four-o'clock position), and vice versa.

In the engagement position, the free end of the bar 118 is accommodated in a corresponding accommodation slot 13' to prevent the sliding of the unwinding turns on the rod 13". During turn unwinding, the bar 118 is in the release position, and when the last-but-one unwinding turn is reached, the bar starts moving in the same direction as the turn unwinding direction F towards the engagement position (for example, clockwise with reference to FIG. 5) and reaches this position at the end of the unwinding of the $n^{th}$ last turn.

The bar moves gradually from the release position to the engagement position according to a rule of motion that is controlled by the microprocessor μP; this gradual motion effectively damps the mechanical tension peak generated on the thread as a consequence of the engagement of the thread with said bar. For this purpose, the motor 132 is powered so as to move the bar 118 from the release position to the engagement position with a uniformly decelerating motion starting from an initial peripheral speed of said bar that is substantially equal to that of the unwinding thread.

This motion rule is qualitatively represented in the chart of FIG. 6, showing that the bar 118 initially undergoes a quick acceleration a, which brings it up to an initial peripheral speed Vi substantially equal to the unwinding speed of the turns of thread, and then undergoes a constant deceleration a', which makes it stop in the final engagement position. The initial contact of the thread with the bar 118 occurs when said bar reaches the accommodation slot 13' with a peripheral speed Vi, so that said contact generates practically no mechanical tension at all on said thread, whereas during the subsequent deceleration step the bar gradually stops the thread, effectively damping the tension peak T1 shown in FIG. 1.

The reverse rotation of the motor 132, performed according to any motion rule by the microprocessor μP following an actuation signal "t" from the loom, moves the bar 118 into the release position when said loom inserts a new weft beat.

Figure 7:
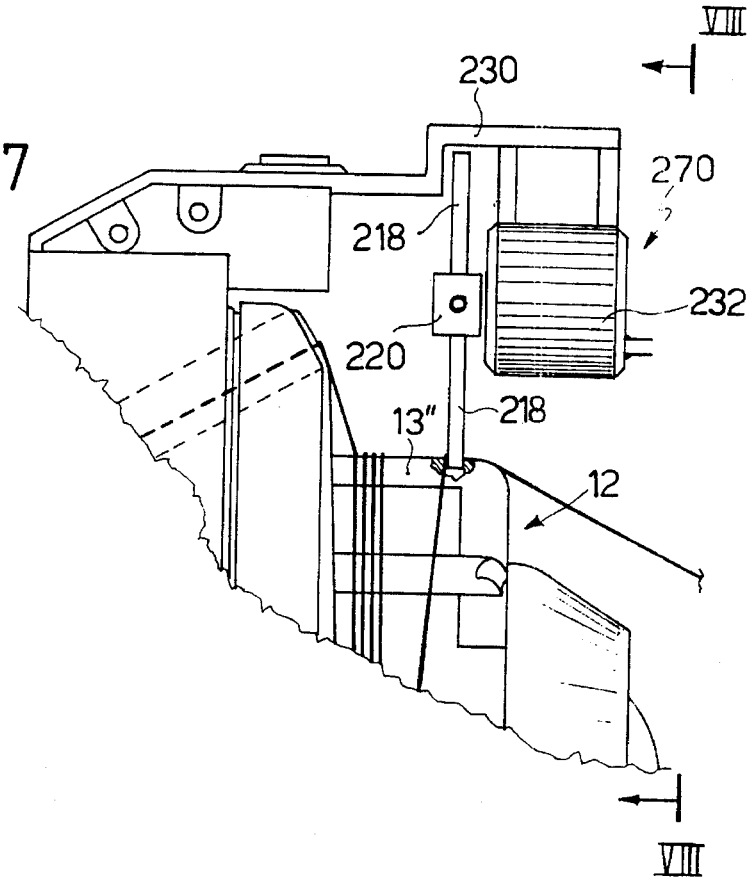
FIG. 7 is a partial sectional view, similar to FIG. 4*a*, of another embodiment of the invention.
Figure 8:
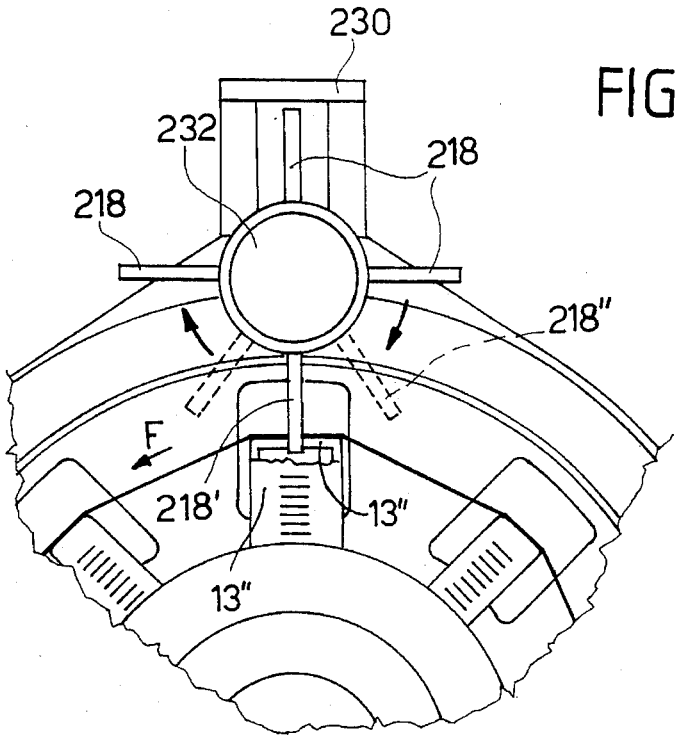
FIG. 8 is a view taken in the direction of the arrows VIII—VIII of FIG. 7.

According to the embodiment of FIGS. 7 and 8, the arrester 270 uses two or more bars, for example four bars 218 supported by the hub 220 of the motor 232 and spaced by an angle of 90°, which move in a single rotational direction that matches the thread unwinding direction F, and move alternately between the engagement position (six-o'clock position) and the release position. This last position is reached by the generic bar 218' after a rotation of the hub 220 of the motor 232 that is equal to approximately one quarter of the angle formed between two consecutive bars; in the illustrated example, after approximately 20°–22° of rotation (approximately seven-thirty position). Correspondingly, the subsequent bar 218" moves into an intermediate position, wherein it does not interfere with the thread, and wherefrom the thread arresting stroke begins, moving said bar into the corresponding engagement position with the same motion rule as in FIG. 6.

The details of execution and the embodiments may of course be altered extensively with respect to what has been described and illustrated by way of non-limitative example without altering the concept of the invention and without thereby abandoning the scope of the invention defined by the appended claims, wherein the reference numerals are provided only for the sake of better comprehension.

What is claimed is:

1. A thread arrester for air-jet loom weft feeders comprising:

a thread arrester finger movable with respect to a feeder reel of a weft feeder from which thread is unwindable;

movement means for controlling movement of said arrester finger to a position for engaging the thread so as to stop unwinding of the thread from said reel and respectively for releasing said thread to unwind further from said reel;

support means for supporting said arrester finger such that said arrester finger is rotatably suspended about a rotation axis that is parallel to and arranged distally from a central longitudinal axis of said reel;

motor means for actuating said arrester finger to rotate said arrester finger about said rotation axis by a preset angular step in an unwinding direction of the thread so that the arrester finger follows said thread during an arresting phase whereby for damping a peak of mechanical tension generated on the thread upon contact with said arrester finger.

2. Arrester according to claim 1, wherein said thread arrester finger is accommodated inside a thread arrester body and controlled by said movement means comprising electromagnetic means which are energized by an energization current, said electromagnetic means moving said arrester finger radially with respect to the central longitudinal axis of said reel of the feeder; said thread arrester body being oscillatable about said support means, said support means comprising two diametrically opposite supports, a first support being freely rotatably fitted on a supporting pivot supported by a fixed structure, and a second support being keyed on a shaft of said motor means which makes the thread arrester body rotate in the unwinding direction of the thread and viceversa.

3. Arrester according to claim 2, wherein the supporting pivot and the shaft of the motor define said rotation axis for the rotation of the arrester finger.

4. Arrester according to claim 2, wherein the motor that produces the rotation of said arrester finger is of the step type and is supplied by the same energization current that moves the arrester finger radially.

5. Arrester according to claim 2, wherein the arrester finger, in the arresting phase, engages and moves inside a slot formed on a rod of the reel of the feeder.

6. Arrester according to claim 2, comprising at least one arrester bar arranged radially with respect to the reel of the feeder which is fixed, said arrester bar being actuated by said motor means comprising an electric motor and being movable to assume, by virtue of controlled rotation of the shaft of said motor, an angular engagement position for engaging thread turns unwinding from the fixed reel, and a release position for freely unwinding said turns such that an angular movement of said bar from the release position to the engagement position in a turn unwinding direction is a uniformly decelerating motion starting from an initial peripheral speed that is substantially equal to a speed of the unwinding thread.

7. Arrester according to claim 6, wherein the arrester bar is arranged to be rotatably moveable about said rotation axis by means of said motor means.

8. Arrester according to claim 6, comprising at least two arrester bars acted upon by said motor means such that said at least two arrester bars move in a single rotational direction following the thread unwinding direction, and such that said at least two arrester bars move alternately between a turn engagement position and a turn release position.

9. Arrester according to claim 8, comprising four arrester bars angularly spaced through 90°.

10. Arrester according to claim 6, wherein an end of each of said at least one arrester bar is accommodated, in a turn engagement position, inside a corresponding accommodation slot formed on an underlying rod of said fixed reel.

11. Arrester according to claim 6, wherein said arrester bar is actuated by said motor means such that said angular movement of said at least one arrester bar from the release position to the engagement position comprises a rapid-acceleration portion that gives the at least one bar the initial peripheral speed, which is substantially equal to an unwinding speed of the thread turns, followed by a constant deceleration that makes each said at least one bar stop in a final engagement position.

12. Arrester according to claim 10, wherein said at least one arrester bar is actuated by said motor means such that initial contact of the thread turn with each individual arrester bar occurs when said each individual arrester bar reaches said accommodation slot with said initial peripheral speed.

13. A thread arrester for air-jet loom weft feeders comprising:

a thread arrester finger selectively movable with respect to a feeder reel of a weft feeder from which thread is unwindable between an engagement position in which said thread arrester finger engages the thread so as to stop unwinding of the thread from said reel and a release position in which said thread arrester finger does not engage the thread for releasing said thread to unwind further from said reel;

a movement device for moving said thread arrester finger between said engagement and release positions;

a support for supporting said arrester finger such that said arrester finger is rotatably suspended about a rotation axis that is parallel to and arranged distally from a central longitudinal axis of said reel;

a motor for actuating said arrester finger to rotate said arrester finger about said rotation axis by a preset angular step in an unwinding direction of the thread so that the arrester finger follows said thread during an arresting phase whereby for damping a peak of mechanical tension generated on the thread upon contact with said arrester finger.

14. The thread arrester of claim 13 wherein said arrester finger has a longitudinal extension which extends radially and substantially perpendicularly from said rotation axis.

15. The thread arrester of claim 14 wherein said arrester finger is movable by said movement device in a direction of said longitudinal extension of said arrester finger.

16. The thread arrester of claim 14 wherein said movement device comprises said motor.

17. In combination, a thread arrester and an air-jet loom weft feeder, the combination comprising:

a thread arrester finger selectively movable with respect to a feeder reel of the weft feeder from which thread is unwindable between an engagement position in which said thread arrester finger engages the thread so as to stop unwinding of the thread from said reel and a release position in which said thread arrester finger does not engage the thread for releasing said thread to unwind further from said reel;

a movement device for moving said thread arrester finger between said engagement and release positions;

a support for supporting said arrester finger such that said arrester finger is rotatably suspended about a rotation axis that is parallel to and arranged distally from a central longitudinal axis of said reel;

a motor for actuating said arrester finger to rotate said arrester finger about said rotation axis by a preset angular step in an unwinding direction of the thread so that the arrester finger follows said thread during an arresting phase whereby for damping a peak of mechanical tension generated on the thread upon contact with said arrester finger.

18. The combination of claim 17 wherein said arrester finger has a longitudinal extension which extends radially and substantially perpendicularly from said rotation axis.

19. The combination of claim 18 wherein said arrester finger is movable by said movement device in a direction of said longitudinal extension of said arrester finger.

20. The combination of claim 18 wherein said movement device comprises said motor.

* * * * *